US005494520A

United States Patent [19]

Lamendola et al.

[11] Patent Number: 5,494,520

[45] Date of Patent: Feb. 27, 1996

[54] APPARATUS FOR COATING JET MILLED PARTICULATES ONTO A SUBSTRATE BY USE OF A ROTATABLE APPLICATOR

[75] Inventors: Nicholas M. Lamendola, Lima; Eugene A. Swain, Webster, both of N.Y.

[73] Assignee: Xerox Corporation, Stamford, Conn.

[21] Appl. No.: 319,695

[22] Filed: Oct. 7, 1994

[51] Int. Cl.[6] ..... B05C 1/00

[52] U.S. Cl. ..... 118/608; 118/232; 118/244; 427/194

[58] Field of Search ..... 427/11, 180, 194; 118/210, 244, 76, 77, 608, 232, 233, 249; 241/5

[56] References Cited

U.S. PATENT DOCUMENTS

| | | | |
|---|---|---|---|
| 4,325,988 | 4/1982 | Wagner | 427/160 |
| 4,401,695 | 8/1983 | Sopko | 427/180 |
| 4,741,918 | 5/1988 | Nagy de Nagybaczon et al. | 427/11 |
| 4,948,632 | 8/1990 | Breininger | 427/255 |
| 5,184,754 | 2/1993 | Hansen | 222/55 |
| 5,247,052 | 9/1993 | Lücke et al. | 528/125 |
| 5,277,535 | 1/1994 | Bullivant | 414/326 |
| 5,301,844 | 4/1994 | Ricciardi | 222/199 |
| 5,368,890 | 11/1994 | de Nagybaczon | 427/180 |

OTHER PUBLICATIONS

Accurate Inc., "Volumetric Feeders," vol. T5M Mar. 1993 (undated).

Fluid Energy Aljet, "Jet-O-Mizer® Size Reduction Systems" (undated).

*Primary Examiner*—Terry J. Owens

*Attorney, Agent, or Firm*—Zosan S. Soong

[57] ABSTRACT

A film coating apparatus and feed system therefor which comprise:

(a) a feeder for dispensing a particulate material at a substantially uniform rate;

(b) a jet mill which receives the particulate material from the feeder, wherein the jet mill processes the particulate material by breaking up particle agglomerations and by dispersing substantially uniformly the particulate material into a carrier fluid to result in a processed particulate material;

(c) a substrate coating assembly comprising a rotatable applicator; and (d) a tubing having a material receiving end to receive the processed particulate material from the jet mill and a material feeding end to dispense the processed particulate material to the substrate coating assembly, wherein the feeding end is adjacent the surface of the applicator.

12 Claims, 1 Drawing Sheet

APPARATUS FOR COATING JET MILLED PARTICULATES ONTO A SUBSTRATE BY USE OF A ROTATABLE APPLICATOR

This invention relates generally to an improved feed system for a film coating apparatus and process such as that illustrated for example in Nagy de Nagybaczon et al., U.S. Pat. No. 4,741,918. The film coating apparatus and process disclosed in the Nagy de Nagybaczon patent produce thin film coatings by feeding for instance dry powders to a rotatable applicator rotating at high speeds. The quality of the coatings made by the high speed coating process is dependent on the size of the feed particles and how uniformly they are fed to the applicator. When used for film coating, it has been found that fluidized beds, a conventional feed system, do not feed uniformly, tend to form particle agglomerations which cannot be conveyed to the applicator, and do not allow the feed rate to be varied accurately. Determining the feed rate is difficult with fluidized bed type feed systems. There is a need for an improved feed system for film coating which overcomes one or more of the above problems associated with fluidized bed feeders.

Volumetric and gravimetric feeders are described in Hansen, U.S. Pat. No. 5,184,754, Bullivant, U.S. Pat. No. 5,277,535, Ricciardi, U.S. Pat. No. 5,301,844, and a brochure (8 pages) from AccuRate Inc. titled "Volumetric Feeders," Vol. T5M 3–93, the disclosures of which are totally incorporated by reference.

Jet mills, alone or in combination with feeders, are described in for example Lucke et al., U.S. Pat. No. 5,247,052, Wagner, U.S. Pat. No. 4,325,988, Breininger, U.S. Pat. No. 4,948,632, Sopko, U.S. Pat. No. 4,401,695, and a brochure (4 pages) from Fluid Energy Aljet titled "JET-O-MIZER® Size Reduction Systems," the disclosures of which are totally incorporated by reference.

SUMMARY OF THE INVENTION

It is an object of the invention in embodiments to provide a feed system for a film coating apparatus and process which offers a number of advantages over a fluidized bed feeder system.

It is a further object of the invention in embodiments to provide an improved feed system for a film coating apparatus and process which results in substantially uniform substrate coatings.

These objects and others are accomplished in embodiments by providing an apparatus comprising:

(a) a feeder for dispensing a particulate material at a substantially uniform rate;

(b) a jet mill operatively associated with the feeder which receives the particulate material from the feeder, wherein the jet mill processes the particulate material by minimizing particle agglomerations and by dispersing substantially uniformly the processed particulate material into a carrier fluid to result in a processed particulate material; and (c) a substrate coating assembly operatively associated with the jet mill which receives from the jet mill the processed particulate material, wherein the substrate coating assembly comprises a rotatable applicator.

BRIEF DESCRIPTION OF THE DRAWINGS

Other aspects of the present invention will become apparent as the following description proceeds and upon reference to FIG. 1 which represents a preferred embodiment.

DETAILED DESCRIPTION

Figure 1:
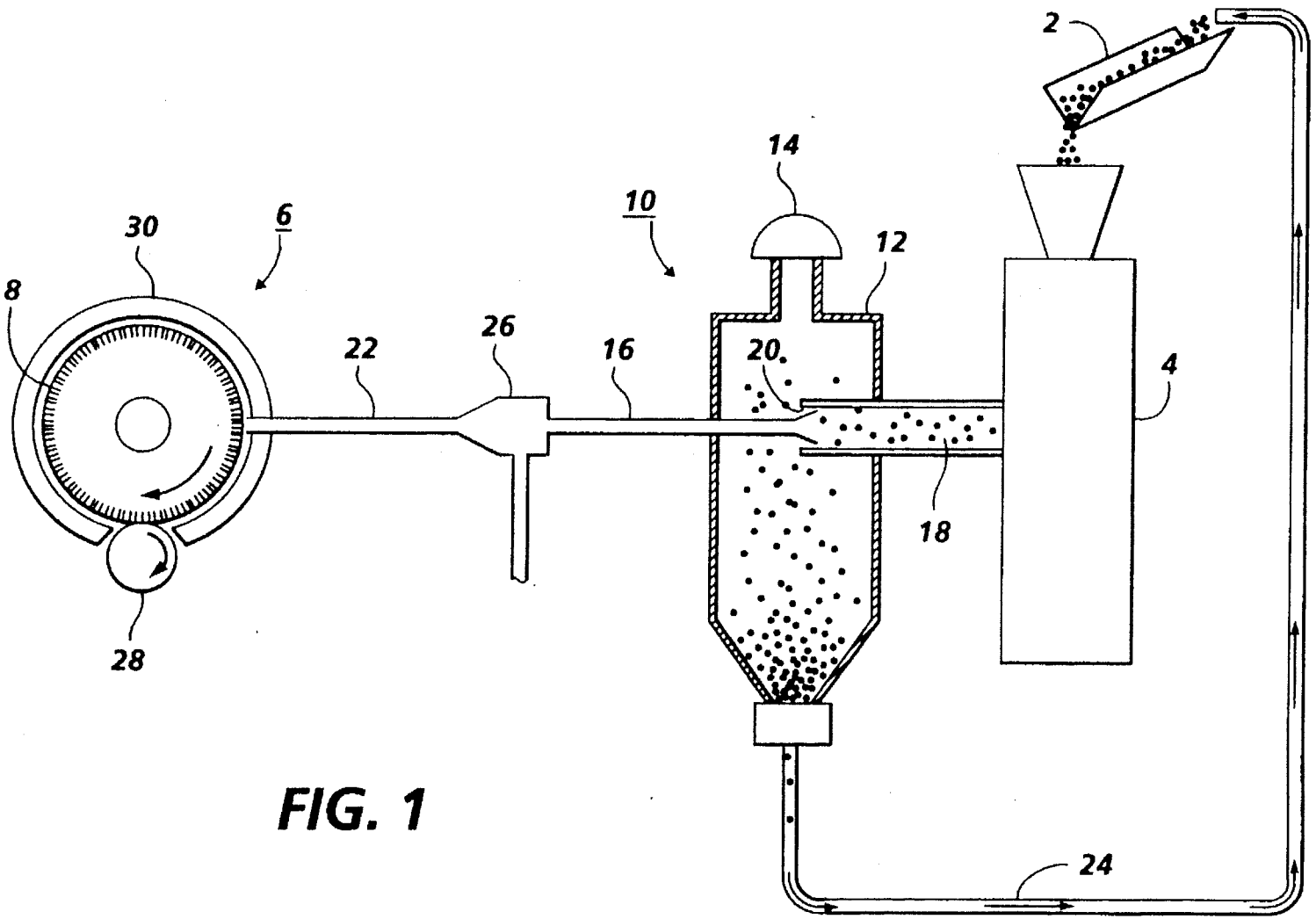
FIG. 1 represents a schematic side view of an improved feed system for a film coating apparatus.

FIG. 1 illustrates a film coating apparatus comprised of a feeder 2, a jet mill 4, and a substrate coating assembly 6 comprised of a rotatable applicator 8. The feeder 2 dispenses a particulate material at a substantially uniform rate, preferably a uniform rate, to the jet mill 4. The feeder 2 may be any suitable apparatus including for example a volumetric feeder or a gravimetric feeder. In a volumetric feeder, material is dispensed in terms of volume per unit of time, e.g., cubic inches per minute. Volumetric feeders are generally dependent on a consistent bulk density of the material for an accurate and uniform feed rate. Many, if not most, gravimetric feeders are of the so-called loss-in-weight type. In some, the material is fed or dispensed via a belt, and in others by an auger or feed screw. Commonly, the weight of the supply hopper and its contents and sometimes the belt or auger as well, is noted at regular intervals and the feed rate (belt or auger speed) is adjusted as necessary to maintain the desired weight dispensing rate. Volumetric and gravimetric feeders are available from for example AccuRate (Whitewater, Wis.) such as the "100 Series" volumetric feeders. The gravimetric feeder dispenses a particulate material at a substantially uniform rate, preferably a uniform rate, ranging for example from about 10 to about 200 grams per hour, and preferably from about 50 to about 100 grams per hour. The volumetric feeder dispenses a particulate material at a substantially uniform rate, preferably a uniform rate, ranging for example from about 0.000017 to about 0.5 cubic feet per hour, and preferably from about 0.0020 to about 0.1 cubic feet per hour.

In embodiments of the present invention, the jet mill 4 is used primarily to minimize particle agglomerations and to disperse the particles of the particulate material substantially uniformly, preferably uniformly, in the carrier fluid. Of course, the jet mill can also reduce the particle size if desired. The jet mill is a comminuting apparatus in which particles to be comminuted are accelerated by fluid streams and comminuted by mutual impingement. There are a number of different jet mill designs. They differ in the type of carrier fluid, in the type of impingement of the particles on one another or on an impingement surface and in whether the particles to be comminuted are carried along in the carrier fluid jet or whether the the carrier fluid jet impinges upon the particles and entrains them. The carrier fluid preferably is a gas and may be for example air, superheated steam, or nitrogen. Jet mills are available for example from Fluid Energy Aljet (Plumsteadville, Pa.) under the tradename JET-O-MIZER®. A miniature jet mill such as the JET-O-MIZER® Mill Series Number 000 is preferred. The jet mill preferably has an output capacity ranging for example from about 10 to about 200 grams per hour, and preferably from about 50 to about 100 grams per hour. The output of the jet mill comprises particles of the particulate material, having minimal or no agglomerations, which are substantially uniformly, preferably uniformly, dispersed in the carrier fluid.

In embodiments of the invention, the output of the jet mill 4 may be greater than the requirement of the substrate coating assembly 6, i.e., the jet mill may supply too much material to the applicator 8, resulting for example when a high carrier fluid flow rate is needed to properly disperse the material. In such a situation, the substrate coating assembly 6 may further comprise an optional regulating apparatus 10 to regulate or control the amount of particulate material flowing in the carrier fluid from the jet mill. The regulating apparatus 10 may comprise for instance an excess material collection vessel 12 and a vent 14. A portion of the carrier fluid containing the particulate material from the jet mill escapes into the collection vessel 12. This may be accomplished in embodiments by coupling one end of a receiving tube 16 to the output tube 18 of the jet mill. The end of the receiving tube 16 may be flared and is narrower than the output tube 18, resulting in a gap 20 between the outer surface of the receiving tube and the inner surface of the output tube. The interior of the collection vessel 12 is in communication with the gap 20, thereby separating the carrier fluid containing the particulate material into a first portion which enters the receiving tube 16 and a second portion which escapes into the collection vessel 12. In embodiments, the rate at which the carrier fluid and the particulate material enter the collection vessel may be controlled by adjusting the feeder dispensing rate and the amount of fluid in the jet mill. Carrier fluid may leave the collection vessel through vent 14. The regulating apparatus 10 may further include a recirculation line 24 to convey excess particulate material from the collection vessel 12 to the feeder 2. The receiving tube 16 is in communication with the feed tube 22, wherein the end of the feed tube may be disposed adjacent the surface of the applicator 8.

The substrate coating assembly 6 may further include an optional vacuum producing device 26 such as an eductor, wherein the vacuum producing device may be operatively associated with the jet mill 4 and the applicator 8. The vacuum producing device 26 may be coupled for example with the receiving tube 16 and the feed tube 22. The vacuum producing device facilitates the flow of carrier fluid and particulate material towards the applicator from the jet mill by creating a vacuum in the receiving tube 16 to collect a portion of the particulate material from the collection vessel 12 and to direct it to the substrate coating assembly 6 by pressurizing the feed tube 22.

The vacuum producing device 26 is optional since a vacuum may be promoted at the end of the feed tube 22 by the rotation speed of the applicator 8 and by the particular positioning of the feed tube. A "chimney" effect (where carrier fluid and the particulate material may be sucked out of the feed tube) may be created by the rapid movement of air past the end of the feed tube. To promote a vacuum at the end of the feed tube, the applicator may be spinning at a surface speed ranging for example from about 100 fps (feet per second) to about 1000 fps, preferably from about 400 fps to about 800 fps, and especially about 700 fps. To promote a vacuum, the end of the feed tube may be disposed adjacent the applicator either near the rotation axis on a side surface of the applicator or close to its circumferential surface, where the distance between the applicator and the end of the feed tube ranges for example from about 0.5 mm to about 10 mm, preferably from about 1 mm to about 2 mm, and especially about 1 mm.

In embodiments of the present invention, the output of the jet mill 4, i.e., the carrier fluid and the particulate material, may be directed at the substrate 28, wherein, for example, the feed tube 22 may be disposed adjacent the substrate surface at a distance and positioning similar to that disclosed herein when the feed tube is positioned adjacent the applicator surface. Thus, in embodiments, the substrate 28 may constitute an element of the substrate coating assembly 6, wherein the substrate may be operatively engaged with the applicator. The substrate may be rotating in embodiments at a speed ranging for example from about 200 to about 4000 rpm, preferably from about 300 to about 3000 rpm, and especially about 2000 rpm.

The applicator 8 may be in the shape of a roller or wheel. In embodiments, the applicator 8 is shorter in length than the substrate 28 and the applicator traverses across the length of the substrate to apply the particulate material at a traverse speed ranging for example from about 1 to about 10 mm/minute, preferably from about 3 to about 8 mm/minute, and especially about 5 mm/minute. The substrate coating assembly 6 may further comprise a housing 30, which may be closed on both ends, to encompass the applicator. The distance between the housing and the applicator surface may range for example from about 1 to about 20 mm, preferably from about 3 to about 10 mm, and especially about 5 mm. A particularly preferred applicator for use in the method of the invention is a jeweler's buffing wheel. Suitable buffing wheels include those available from W. Canning Materials Limited, Great Hampton Street, Birmingham, England. These buffing wheels generally comprise a plurality of fabric discs clamped together in a way which allow the density of fabric at the periphery of the wheel to be adjusted.

In embodiments of the present invention, the applicator 8 may be made for example from sheets of cotton fabric cut in 10 cm diameter discs with a hole in the center of each disc of 2.5 cm diameter. These cotton discs are then pulled onto a threaded steel shaft of 2.5 cm diameter and are retained by 6 mm thick steel washers of 8.9 cm diameter to form an applicator 30 cm wide. The washers in turn are retained by suitable nuts. The cotton discs are compacted by tightening the retaining nuts to produce a density at the perimeter face of the compacted cotton mass appropriate to the material to be coated.

The preferred applicator is made from sheets of high purity cotton fabric cut into 30 cm diameter discs. A number of these discs, preferably 12, are layered so that every other disc has its weave at an angle of 45 degrees to each other. The layers are then placed in a two piece mold specially designed to allow low viscosity epoxy to be injected, which results in a hub made up of cotton reinforced epoxy. The hub diameter is less than the diameter of the discs (preferably 25 cm in diameter) thereby allowing the discs to have for example 2.5 cm in length of free fibers. The applicator can also include other layers of material to reinforce the applicator enabling it to withstand the high speeds of rotation. Material such as KEVLAR™ or graphite, preferably 3 layers of KEVLAR™ distributed uniformly among the cotton layers, are included in the composition of the applicator.

The particulate material (also referred herein as "coating material") is rubbed across the surface of the substrate by the applicator having a resilient surface which is in sliding contact with the substrate. The coating material can be selected from an enormous variety of materials. For example, it may be an organic polymer. Illustrative examples include; polyolefins such as polyethylene, polypropylene, polybutylene and copolymers of the foregoing; halogenated polyolefins such as fluorocarbon polymers; polyesters such as polyethyleneterephthalate; vinyl polymers such as polyvinylchloride and polyvinyl alcohol; acrylic polymers such as polymethylmethacrylate and polyethylmethacrylate; and polyurethanes. Alternatively, the coating material may be a metal such as gold, silver, platinum, iron, aluminium, chromium or tantalum. Further examples of suitable coating materials include magnetic oxides such as magnetic iron oxide and magnetic chromium dioxide, minerals such as quartz, organic and inorganic pigments, and even such materials as diamond and china clay. Yet, further examples include metalloid elements such as phosphorus, silicon, germanium, gallium, selenium and arsenic, optionally doped with other materials to confer desired semiconductor properties.

If desired, mixtures of different kinds of particles may also be used.

Products which may be made by the invention include magnetic recording media and electrical components having conducting resistive, dielectric or semiconducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and even abrasive coatings on substances such as metal, paper, glass, ceramics, fabrics and plastics. A preferred use for the invention is for the application of layered material during the fabrication of a photoreceptor. Preferred layered materials are photogenerating materials. Illustrative photogenerating materials include inorganic photoconductive particles such as amorphous selenium, trigonal selenium, and selenium alloys including for instance selenium-tellurium, selenium-tellurium-arsenic, selenium arsenide and mixtures thereof, and organic photoconductive particles such as various phthalocyanine pigments such as the X-form of metal free phthalocyanine described in U.S. Pat. No. 3,357,989, the disclosure of which is totally incorporated by reference, metal phthalocyanines such as vanadyl phthalocyanine and copper phthalocyanine, dibromoanthanthrone, squarylium, quinacridones available from DuPont under the tradenames Monastral Red, Monastral Violet and Monastral Red Y. Pigments also include dibromoanthanthrone pigments available from Imperial Chemical Industries under the tradenames Vat Orange 1 and Vat Orange 3, benzimidazole perylene, substituted 2,4-diamino-triazines disclosed in U.S. Pat. No. 3,442,781, the disclosure of which is totally incorporated by reference, and polynuclear aromatic quinones available from Allied Chemical Corporation under the tradenames Indofast Double Scarlet, Indofast Violet Lake B, Indofast Brilliant Scarlet, Indofast Orange, and the like. Polymers such as polymethacrylate, 2-hydroxy ethyl methacrylate, a series of nylons and polyesters can be applied as blocking layers in addition to inorganic oxides such as zirconium oxide silicon dioxide, and the like.

The particles of coating material will generally be less than 100 microns in size. However, the most appropriate particle size will depend to some extent on the chemical nature of the coating material and on the physical and chemical nature of the substrate. Usually, the particles will have a maximum diameter of less than 50 microns and more usually a maximum diameter less than 30 microns. For example, the particles may have a maximum diameter of from 0.5 to 30 microns, such as from 1 to 10 microns.

The particles of coating material may be delivered to the surface of the applicator or the substrate in the dry state, for example in a gas stream. It may be possible in embodiments to deliver the particles to the surface of the applicator or substrate in the form of a liquid dispersion, such dispersions being readily controllable. Preferably, the dispersing liquid is sufficiently volatile to evaporate almost instantly, leaving the particles in a substantially dry state. A suitable dispersing liquid is trichlorotrifluoroethane, though other low-boiling halogenated hydrocarbons can also be used, as can other liquids such as water.

The method of the invention can be used for coating virtually any substrate, whether flexible or rigid, smooth or rough. The substrate may be a flexible or rigid cylinder, preferably hollow, fabricated for example from a metal such as nickel, steel, aluminum, and the like. The process may be also used to great advantage for coating paper and woven and nonwoven fabrics (whether of natural fibers such as cellulosic fibers, or synthetic fibers such as polyesters, polyolefins, polyamides and substituted celluloses) and other materials of a soft nature. The coatings can be formed using a wide range of process conditions, which are all dependent on each other. Thus, when the applicator is in the form of for example a wheel which is used to rub particles of coating material across the substrate, the pressure applied by the wheel, the area of contact between the wheel and the substrate, the peripheral speed of the wheel, and the relative speed between the surface of the wheel and the substrate may all be varied. However, alteration of any one of these parameters may require that one or more of the other parameters be adjusted in order to compensate.

In addition, of course, the conditions which are appropriate for forming a coating of a given material on a given substrate may not be appropriate for coating a different substrate or for coating with a different coating material. In all cases, however, the appropriate process conditions will be readily determinable by the person skilled in the art.

Generally, the more delicate the substrate, the lower the pressure with which the particles of coating material should be pressed against the substrate, in order to avoid damage thereto. Thus, for example, a very lightweight nonwoven fabric may be coated with plastic materials using a 30 cm diameter soft fabric applicator wheel, by training the fabric round the wheel, and applying only a slight tension (e.g., from 10 to 100 grams/cm width of fabric, depending on the strength of the fabric). With this arrangement, the pressure; with which the wheel bears against the fabric is very low indeed, for example from less than 1 g/cm$^2$ to a few grams/cm$^2$. However, such low pressures are compensated for by the fact that the individual particles of coating material are drawn over a very substantial length of the nonwoven fabric, such as from one quarter to three quarters of the circumference of the wheel.

When relatively sturdy substrates are used, it may be appropriate to use still larger contact pressures between the applicator and the substrate. For example, pressures greater than 1 kg/cm$^2$ may be appropriate for coating metals with other relatively hard materials (such as metals, metal oxides, and the like). Dynamic pressures of from 2 to 100 kg/cm$^2$ are most frequently used for this kind of coating, for example from 5 to 50 k/cm$^2$.

Although the factors which determine the appropriate coating conditions for different substrates are imperfectly understood, it will be apparent that identifying the appropriate conditions for a given substrate is merely a matter of trial and error. The operator need only choose a coating technique which is appropriate to the strength and flexibility of the substrate in question, and then increase the applicator pressure and/or applicator speed until a desired coating is formed.

Moreover, in each case the coating formed is very thin, but nonetheless highly adherent, non-granular in appearance and substantially free of micropores. Even in cases when the coating material had a very high melting point, the coating may have a characteristic smeared appearance under high magnification scanning electron microscopy, strongly suggesting plastic deformation of the particles of coating material at the time of film formation.

The coatings formed by the method of the present invention have a number of important characteristics. Firstly, they are very thin, being less than for example 3 microns in thickness. More usually, they are substantially thinner than this, very often being less than 500 nm thick and often less than 200 nm thick. Typical film thicknesses are from 1 to 100 nm thick, preferably from 5 to 50 nm thick. A most unusual characteristic of the process of the invention is that in embodiments, the coatings produced thereby are effectively self-limiting in thickness, in the sense that the coating, once formed, will generally not increase in thickness even when more of the same coating powder is rubbed over the surface. Another preferred characteristic of the films formed by the process of the invention is that they may be substantially nonporous. This is highly unusual in such thin coatings. Yet a further characteristic of the coatings formed by the method of the invention is that they are generally substantially free of voids. This is in marked contrast to the coatings formed by many prior art techniques, such as sputtering. Also, coatings produced by the instant invention are substantially uniform, preferably uniform, in thickness over very large areas of surface such as 800 $cm^2$ as revealed by visual inspection.

Additional details of the process to coat particulate material onto the substrate are provided in Nagy de Nagybaczon et al., U.S. Pat. No. 4,741,918, the disclosure of which is totally incorporated by reference.

The feed system of the present invention may provide a number of advantages over a fluidized bed feed system. For example, the feed rate to the substrate coating assembly can be determined by the feeder which can be controlled accurately and measured. Also, the jet mill can disperse or break up any agglomerations and can grind as it feeds particulate material to the substrate coating assembly. Furthermore, the feed system of the present invention can feed more uniformly because the particulate material is mechanically displaced as opposed to being pulled from a fluidized bed. Because the fluidized bed is eliminated there is no build up of large agglomerations in the bottom of the bed and the process will be fed the entire particle size distribution, not just the smaller particles that are light enough to be pulled from the fluidized bed. Finally, the instant invention may allow gases other than air to be used for the carrier fluid and to be introduced into the carrier fluid stream if desired.

Other modifications of the present invention may occur to those skilled in the art based upon a reading of the present disclosure and these modifications are intended to be included within the scope of the present invention.

We claim:

1. An apparatus comprising:

(a) a feeder for dispensing a particulate material at a substantially uniform rate;

(b) a jet mill which receives the particulate material from the feeder, wherein the jet mill processes the particulate material by breaking up particle agglomerations and by dispersing substantially uniformly the particulate material into a carrier fluid to result in a processed particulate material;

(c) a substrate coating assembly comprising a rotatable applicator; and (d) a tubing having a material receiving end to receive the processed particulate material from the jet mill and a material feeding end to dispense the processed particulate material to the substrate coating assembly, wherein the feeding end is adjacent the surface of the applicator.

2. The apparatus of claim 1, wherein the jet mill further processes the particulate material by reducing the particle size.

3. The apparatus of claim 1, wherein the feeder is a volumetric feeder.

4. The apparatus of claim 1, wherein the feeder is a gravimetric feeder.

5. The apparatus of claim 1, wherein the jet mill dispenses to the tubing an amount of the processed particulate material ranging from about 10 mg per minute to about 100 mg per minute.

6. The apparatus of claim 1, further comprising a vacuum producing device coupled to the tubing.

7. The apparatus of claim 1, further comprising a processed particulate material collection vessel coupled to the tubing.

8. The apparatus of claim 1, wherein the carrier fluid is air, steam, or nitrogen.

9. The apparatus of claim 1, wherein the carrier fluid is a gas.

10. The apparatus of claim 1, wherein the rotatable applicator is adapted to rotate at a surface speed ranging from about 100 to about 1000 feet per second.

11. The apparatus of claim 1, wherein the applicator is in the shape of a wheel.

12. An apparatus comprising:

(a) a feeder for dispensing a particulate material at a substantially uniform rate;

(b) a jet mill which receives the particulate material from the feeder, wherein the jet mill processes the particulate material by breaking up particle agglomerations and by dispersing substantially uniformly the particulate material into a carrier fluid to result in a processed particulate material;

(c) a substrate coating assembly comprising a rotatable applicator and a substrate disposed adjacent to the applicator; and (d) a tubing having a material receiving end to receive the processed particulate material from the jet mill and a material feeding end to dispense the processed particulate material to the substrate coating assembly, wherein the feeding end is adjacent the surface of the substrate.

* * * * *